US005215129A

United States Patent [19]

Berresford et al.

[11] Patent Number: 5,215,129

[45] Date of Patent: Jun. 1, 1993

[54] PRESERVING THE CONTENTS OF BEVERAGE CONTAINERS

[75] Inventors: Richard Berresford; David T. Marr, both of Woodbrigde, England

[73] Assignee: Bermar International Limited, Suffolk, United Kingdom

[21] Appl. No.: 765,384

[22] Filed: Sep. 25, 1991

[30] Foreign Application Priority Data

Sep. 28, 1990 [GB] United Kingdom ..... 9021227
Aug. 7, 1991 [GB] United Kingdom ..... 9117028

[51] Int. Cl.[5] ..... B65B 31/04

[52] U.S. Cl. ..... 141/65; 141/66; 141/84

[58] Field of Search ..... 141/65, 66, 64, 63, 141/84; 215/260, 270; 128/265.13

[56] References Cited

U.S. PATENT DOCUMENTS

| | | | |
|---|---|---|---|
| 301,598 | 7/1884 | Hunt | 141/64 |
| 2,303,766 | 12/1942 | Scherbak | 141/65 |
| 2,729,381 | 1/1956 | Wiser | 141/64 |
| 2,757,843 | 8/1956 | Smith | 141/64 |
| 3,515,135 | 6/1970 | Flower et al. | 128/245.25 |
| 3,905,404 | 9/1975 | Cox | 141/64 |
| 3,986,535 | 10/1976 | Meckstroth | 141/64 |
| 4,051,971 | 10/1977 | Saleri et al. | 215/260 |
| 4,684,033 | 8/1987 | Marcus | 215/269 |
| 4,998,633 | 3/1991 | Schneider | 215/260 |

FOREIGN PATENT DOCUMENTS

EPB0234607 9/1987 European Pat. Off. .

*Primary Examiner*—Henry J. Recla
*Assistant Examiner*—David J. Walczak
*Attorney, Agent, or Firm*—Foley & Lardner

[57] ABSTRACT

Beverages, in particular wine, are preserved by forming an atmosphere within the container, above the liquid level, which will help to preserve the qualities of the beverage. In the case of still beverages, a subatmospheric pressure will be produced by placing a non-return valve in the mouth of the container and then evacuating air from the container. In the case of sparkling beverages, a superatmospheric pressure is produced instead. The pressure inside the container is produced by a motor driven pump and is controlled so that when a predetermined pressure level is reached, the pump stops pumping and the container is sealed.

14 Claims, 4 Drawing Sheets

PRESERVING THE CONTENTS OF BEVERAGE CONTAINERS

FIELD OF THE INVENTION

This invention relates to apparatus for preserving the contents of beverage containers by creating a substantially non-injurious atmosphere within the container. The apparatus can be used for example to preserve wine contained in a part-empty wine bottle, in order to prevent the wine from deteriorating as a result of oxidation. The apparatus can however be used with other containers and with other liquids.

BACKGROUND TO THE INVENTION

It is known to preserve wine in wine bottles by evacuating the air space above the liquid once some of the wine has been consumed, and then sealing this evacuated space. European Patent specification EP-B-0234607 describes one method and apparatus by which this can be accomplished. In that specification, a special stopper is placed in the bottle neck. This stopper has a slit in it which acts as a non-return valve in that it opens if a vacuum is created above the stopper, to allow air to be sucked out of the bottle, but closes again as soon as the external pressure is greater than the pressure inside the bottle. To create a vacuum above the stopper, a manual suction pump is used. This operates satisfactorily, but pump operation is time-consuming and strenuous if an adequate level of vacuum is to be produced in the bottle. There is also no convenient or accurate method of determining when a suitable vacuum level has been achieved.

It is also known from U.S. Pat. No. 4,684,033 to preserve wine in an opened wine bottle by inflating a bladder inside the bottle to fill the space above the liquid and to prevent oxygen from reaching the wine. To do this is a time-consuming operation which requires considerable manual dexterity in introducing the uninflated bladder into the bottle, and also requires the bladder to be washed and cleaned after each use.

It is also desirable to preserve sparkling wine, but if this is done by creating a vacuum above the liquid, then the sparkling character of the wine will be entirely lost.

SUMMARY OF THE INVENTION

According to the present invention therefore there is provided apparatus for preserving the contents of a part-filled beverage container, the apparatus comprising a non-return valve adapted to be removably fitted in a mouth at the top of the container, and a motor driven pump communicating with a socket, the socket being adapted to form a seal with the non-return valve, the pump being connectable with the valve to create a pressure inside the container which differs from atmospheric pressure, and means for stopping the pump from pumping through the valve when a predetermined pressure is achieved.

The pump can either create a subatmospheric pressure in the container (for still beverages) or a superatmospheric pressure (for sparkling or carbonated beverages). In the first case, the non-return valve will be effective to prevent air entering the container and in the second case the valve will be effective to prevent air escaping from the container. In the second case, the non-return valve will require a retention device to prevent it being blown out of the mouth of the container by the superatmospheric pressure.

The means for stopping the pump from pumping preferably comprises a pressure sensitive switch in the pneumatic circuit connecting the pump to the socket. The switch may be effective to actually stop pump operation on achieving the desired positive or negative pressure, or may close a valve in the pneumatic circuit between the pump and the socket.

Where a valve is closed in the pneumatic circuit on reaching the desired pressure, the valve is preferably reopened after a short period of time (sufficient to allow the container to be removed from the socket) to dump the pressure in the circuit to atmosphere.

The apparatus may include two sockets, one for communicating with a pressure side of a pump and one for communicating with a suction side. In a preferred embodiment, the two sockets are connected to opposite sides of the same pump.

Parts of these sockets are preferably spring-loaded relative to the switch so that the container mouth has to be pushed into the socket against the spring loading to operate the switch.

The apparatus is preferably constructed so that the action of introducing a container with a valve into a socket causes the pump to be started. The pump motor is preferably electrically driven.

Where a superatmospheric pressure is produced in the container, a filter will be required to filter the air being charged into the container.

In the case of sparkling beverages, the beverage will not be oxidized by the air blown in because a cushion of carbon dioxide evolved from the beverage will sit in between the surface of the beverage and the volume of air blown in thus substantially preventing contact between the oxygen in the air and the beverage.

The vacuum circuit may also include a dump valve which is opened when the pressure responsive switch signals that the desired vacuum has been achieved, to admit air to the vacuum circuit so that the non-return valve in the container mouth closes, and the container can be removed from the apparatus.

The apparatus preferably includes three condition-monitoring indicators which may be in the form of lights. A first indicator indicates "Power On"; a second indicator indicates that the pump is operating, and a third indicator indicates that the pre-set vacuum or pressure has been achieved and that the container can be removed.

The invention is particularly intended and adapted to the preservation of wine (both still and sparkling) contained in conventional glass wine bottles.

The apparatus is particularly suitable for installation behind a bar where a selection of wines is available for sale. It is simple for the bar tender to dispense one glassful from a part-consumed bottle to a customer, then to reinsert the stopper and offer the bottle up to the apparatus so that air can be evacuated from the top of the bottle (in the case of still wines), or can be charged into the bottle to create a superatmospheric pressure (in the case of sparkling wines). The wine can then be put back to store and will stay in good condition. As a result of this invention, it is possible for a wide range of wines to be served one glass at a time without fear of the wine deteriorating to an unacceptable level if the whole contents of the bottle are not sold over a certain period.

DESCRIPTION OF THE DRAWINGS

The invention will now be further described, by way of example, with reference to the accompanying drawings, in which.

DETAILED DESCRIPTION OF PREFERRED EMBODIMENTS

Figure 1:
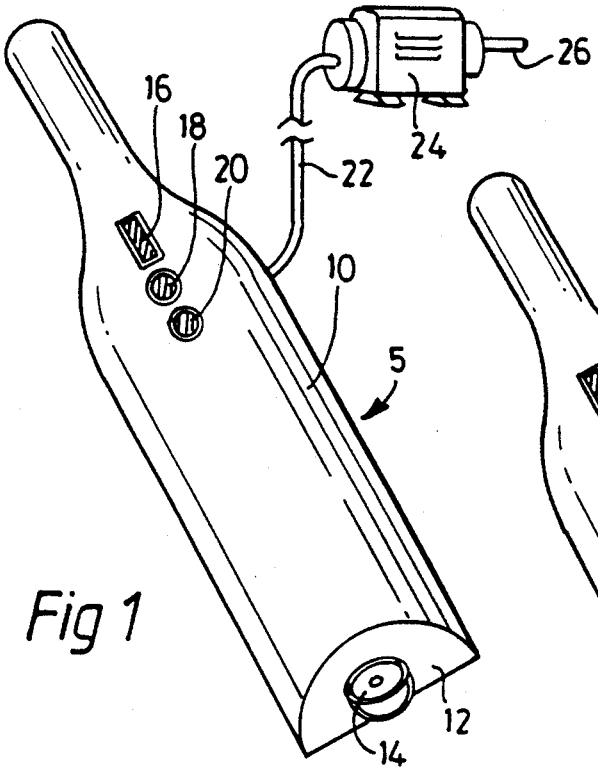
FIG. 1 is a perspective view of a first embodiment of apparatus in accordance with the invention.

FIG. 1 shows a first form of apparatus in accordance with the invention. The apparatus has a housing unit 5 closed by a front cover 10 and a bottom plate 12 in which there is a socket 14. Contained within the housing 12 are components of both pneumatic and electrical circuits which will be described in the following. On the front cover of the housing 12 are an on/off switch 16, an indicator light 18 which lights while the apparatus is working, and a second indicator light 20 which lights to indicate that a desired pressure has been achieved.

The housing unit 5 is connected by a length of flexible tubing 22 to a remote pump 24 which is driven by an electrically powered motor.

In a typical installation, the housing unit 5 will be mounted in an upright position behind a bar or in other places where drinks are served, and the pump 24 will be located out of sight beneath the bar or elsewhere.

As the primary intended use of the apparatus in accordance with the invention is for the preservation of wine, the following description will refer specifically to this use.

Figure 2:
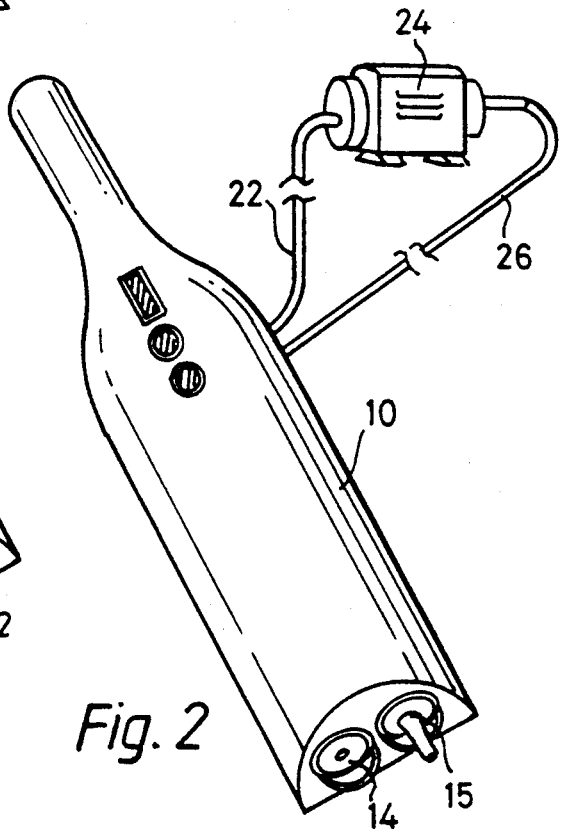
FIG. 2 is a perspective view, corresponding to FIG. 1, but showing a second embodiment of apparatus in accordance with the invention.

The apparatus shown in FIG. 1 is intended specifically for use with still wine, whereas the apparatus shown in FIG. 2 has two sockets 14 and 15 and is intended for use in preserving both still and sparkling wine. Still wine is preserved by creating a vacuum inside the bottle above the wine and below the stopper, and sparkling wine is preserved by creating a superatmospheric pressure in the bottle.

In the case of the apparatus shown in FIG. 1, the pump 24 is set up to evacuate air along the pipe 22, and to discharge the evacuated air to atmosphere through an exhaust port 26. In the case of the embodiment shown in FIG. 2, the pump has its exhaust port 26 connected to the pressurizing socket 15, in a manner which will be described in more detail later on.

Figure 3:
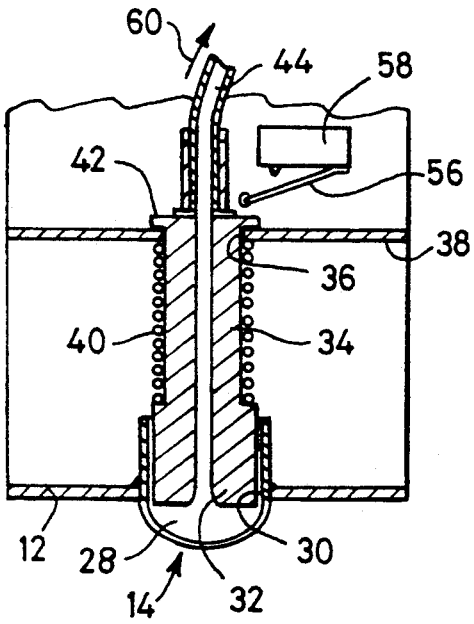
FIG. 3 is a cross-section through part of the first embodiment, with a front cover removed.
Figure 5:
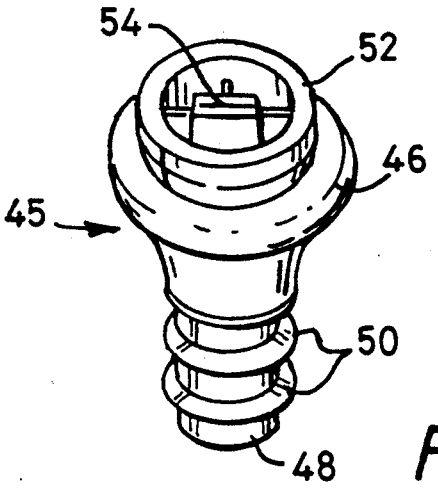
FIGS. 5 and 6 show two alternative bottle stoppers for use with the apparatus of the invention.
Figure 6:
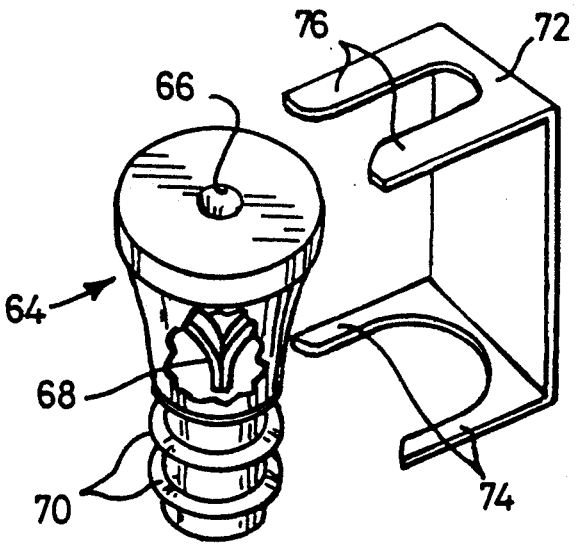

FIG. 3 shows some details of the socket 14 from FIG. 1. A fixed guide plate 28 is mounted around a hole 30 in the bottom plate. A tubular socket 32 is mounted at the bottom end of a sleeve 34, and the sleeve extends upwards through a hole 36 in a second, fixed plate 38. A helical spring 40 surrounds the sleeve 34 and acts against the underside of the plate 38 to bias the socket 32 downwards. At the top end of the sleeve 34 there is an enlarged head 42 which is too large to pass through the hole 36. An air tube 44 is connected into the top of the head 42. The tube 44 communicates via the centre of the sleeve 34 with an open mouth at the bottom of the socket 32, and this open mouth is designed to mate with a sealing shoulder 46 on a specially designed stopper 45 shown in FIG. 5. The stopper has a skirt 48 with sealing ribs 50 around it. The stopper also has a top surface 52 which includes a valve opening 54 in the form of a slit.

When the stopper is inserted in the neck of a bottle, the shoulder 46 sits on the top rim of the bottle neck and the ribs 50 seal against the inside of the neck. Whilst the slit 54 is closed, the bottle is sealed.

The parts of the stopper which support the sides of the slit 54 are constructed so that when the pressure inside the bottle is less than atmospheric, then the greater pressure on the outside of the stopper will keep the slit closed. On the other hand when the external pressure is lower than that inside the bottle, then the slit will open to allow air to be extracted from the bottle.

When a bottle with the stopper in its neck is placed against the bottom end of the socket 32, a seal will be formed between the shoulder and the socket. When the slit 54 is open, the interior of the bottle will then be in communication with the pipe 44.

In order to operate the apparatus, the bottle is pushed upwards against the socket 32 which itself moves upwards against the force of the spring 40. This movement causes the head 42 to rise against the arm 56 of a switch 58, and when the switch 58 is operated, the pump 24 is started. When the pump starts, air is drawn along the pipe 44 in the direction indicated by an arrow 60. A subatmospheric pressure will be thereby produced at the socket 32 and this will cause the valve slit 54 to open and will cause air to be evacuated from the top of the bottle.

Figure 4:
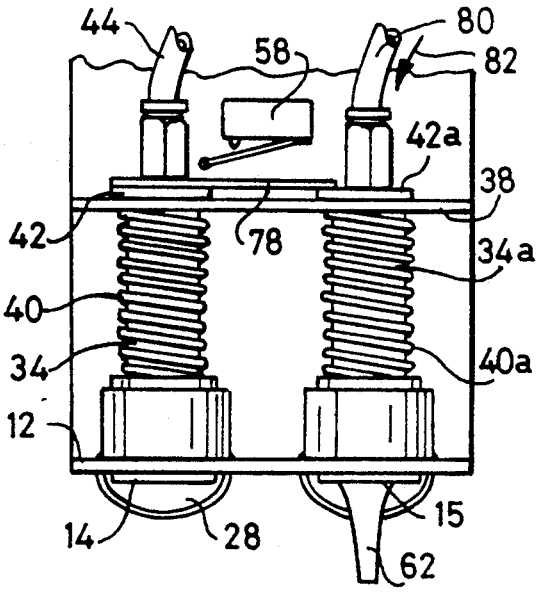
FIG. 4 is a front view of part of the second embodiment, with a front cover removed.

FIG. 4 shows a similar arrangement where the two sockets 14 and 15 are fitted side by side. The bottom end of the socket 15 ends in a nozzle 62, and this cooperates with a stopper 64 which fits in the neck of a bottle of sparkling wine. The stopper 64 which is made of a rubber-like resilient material has a top face with a hole 66 into which the nozzle 62 can be pressed to form a seal. Within the body of the stopper 64 is a one-way valve 68 which operates in a similar way to the valve slit 54 of the stopper in FIG. 5, but in the opposite direction. The stopper 64 also has sealing ribs 70 for sealing with a neck of the bottle.

Because in this case the pressure built up inside the bottle will be above atmospheric it is necessary to provide some means for retaining the stopper in the bottle, to prevent it from being blown out. This takes the form of a retaining clip 72 which has two lower limbs 74 which slide either side of the bottle neck and engage underneath an annular ridge on the bottle neck, and two top arms 76 which engage over the top face of the stopper.

FIG. 4 shows that the switch 58 responds to movement of the socket 14 as described with reference to FIG. 3. The socket 15 is constructed similarly with a sleeve 34*a*, a spring 40*a* and a head 42*a* arranged with respect to holes similar to holes 30 and 36 in the bottom plate 12 and in the upper plate 38. The head 42 of the socket 14 however has a laterally projecting plate 78 fixed to it. When the socket 15 is pushed upwards, the head 42*a* of the socket engages the plate 78 and also lifts the socket 14, so that the switch 58 can be operated. Whichever socket 14 or 15 is being used, the same switch 58 will be operated. Once a bottle is connected to the socket 15, and the pump has been started, air will be blown into the bottle through a pipe 80 in the direction indicated by an arrow 82.

Subsequent to the starting of the motor, various operations take place in sequence, and the further operation will be described with reference to FIGS. 7 and 8.

Figure 7:
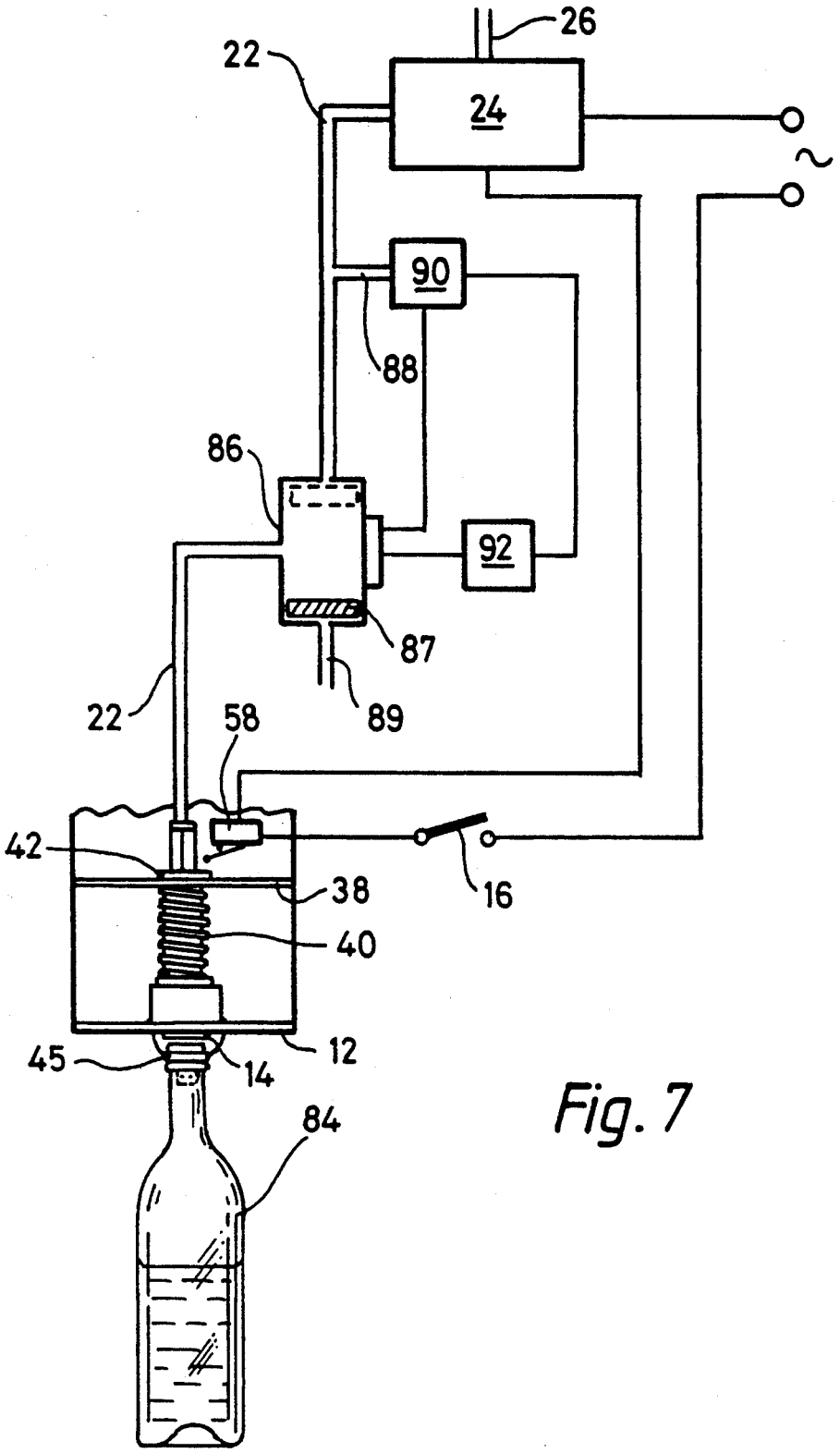
FIGS. 7 and 8 are schematic illustrations indicating the manner of operation of, respectively, the first and the second embodiments of the invention.

FIG. 7 illustrates the pneumatic and electrical circuits associated with the unit shown in FIGS. 1 and 3.

The vacuum pipe 22 passes from the head 42 via a solenoid operated on/off valve 86. The pipe 22 also has a branch line 88 leading to a pressure sensitive switch 90. A timer unit 92 is included in the electrical circuit.

Operation is as follows. The main power on/off switch 16 is first closed to make the unit active. When a part-filled bottle 84 with a stopper 45 is introduced into the socket 14, and the switch 58 is tripped then power will be fed to the pump 24 which will start operation. Air will then be drawn through the pipe 22 and exhausted through the exhaust port 26.

When the system including the pipe 22 and the empty space at the top of the bottle 84 reaches a certain level of vacuum, the pressure sensitive switch 90 will be tripped. When the switch is tripped, three things happen. Firstly a signal is sent to the solenoid operated valve 86 to move the valve member 87 from the position shown in bold lines to the position shown in dotted lines. Secondly a signal is sent to the timer 92 so that this starts to count. Thirdly the warning light 20 is lit. The vacuum in the part of the line 22 nearest to the bottle escapes through a dump outlet 89, so that the operator can remove the bottle 84 from the socket 14. The act of removing the bottle causes the spring 40 to move the head 42 away from the switch 58 which then opens so that the pump 24 stops operating. At this stage there is still vacuum held in the part of the line 22 between the valve 86 and the pump 24, but after a time period of a few seconds the timer 92 sends a signal to the valve 86 to move the valve member 87 back to its original position. The vacuum is then dumped through the socket 14. The whole of the pipe 22 then is again subject to atmospheric pressure.

Figure 8:
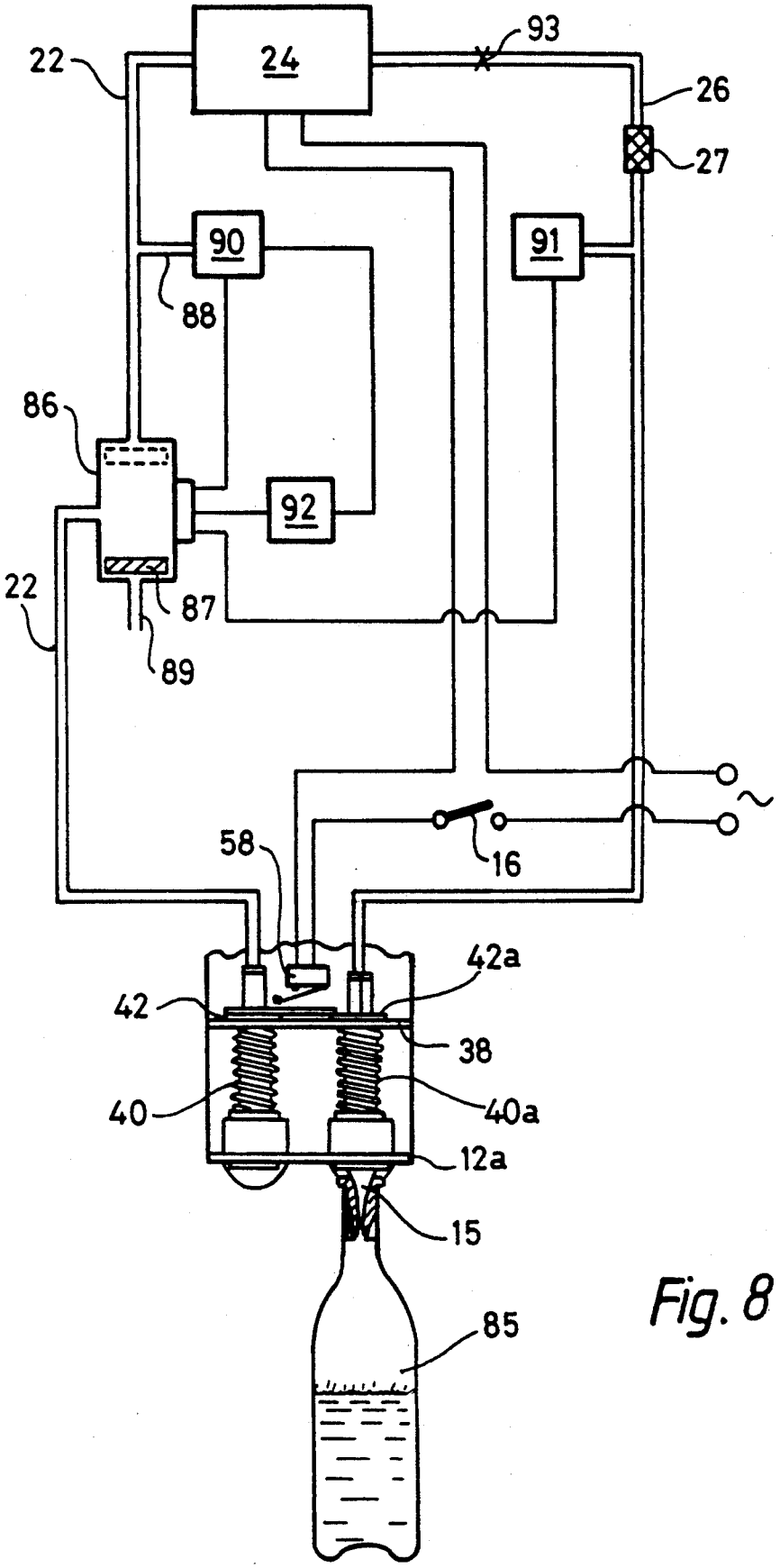

The arrangement shown in FIG. 8 is very similar to that shown in FIG. 7 except that the exhaust port of the pump 24 is redirected to serve the pressure nozzle 15. The exhaust, or pressure, pipe 26 incorporates a filter body 27 and a pressure sensitive switch 91. The filter clears any impurities from the air being charged into the bottle 85. The switch 91 is set so that it trips when a predetermined pressure is reached, that pressure being the pressure required to preserve the contents of a part filled bottle of sparkling wine. When this pressure is sensed by the switch 91, a signal is sent to the valve 86 and the valve member 87 moves from its position shown in bold lines to its position shown in dotted lines. At this point the pump 24 has a closed intake, and so it will not pump any air. The indicator light 20 will light to show that the desired pressure has been reached, and the bottle can then be removed from the nozzle. When this happens the switch 58 will be opened, the pump 24 will stop and the valve member 87 will return to its normal position.

A pressure relief valve 93 is fitted in the pressure pipe 26. In the event that the switch 91 fails, the valve 93 will open at a predetermined pressure above the pressure at which the switch 91 is set, as a safety measure to prevent excessive pressures in the system.

It has been found that a suitable vacuum level to achieve in a part-filled bottle of still wine is 100 mbar, and this can be reached by a suitably rated vacuum pump within five seconds. It is important not to evacuate the bottles too far because this has a detrimental effect on the wine itself. If an excessively low vacuum is produced, this can cause the oxygen naturally present in the wine to be drawn out. Also the relatively volatile alcohol content of the wine may be adversely affected. This could also lead to a risk of bottles imploding. However in other applications where the container is designed to withstand higher levels of vacuum, then the pump can be arranged to pump down to a higher vacuum. In the case of sparkling wine, the apparatus can be set to produce a pressure of about 2 bar in a part-filled bottle.

The apparatus described here can thus be used in public houses and bars to allow a wide range of bottled wines to be available for drinking by the glass. The unconsumed contents of a bottle will be kept fresh as a result of the use of the apparatus described.

We claim:

1. Apparatus for preserving the contents of a part-filled beverage container, the apparatus comprising at least one non-return valve adapted to be removably fitted in a mouth at the top of the container, the valve having an opening allowing communication between the valve and the container, a motor driven pump, and a housing unit including a socket communicating with the pump by a pneumatic circuit, the socket being adapted to form a seal with the non-return valve allowing communication between the pump and the container via the socket and the valve, the pump being connectable with the valve to create a pressure inside the container which differs from atmospheric pressure, and the apparatus also including means for stopping the pump from pumping through the valve when a predetermined pressure is achieved, and wherein the socket is displaced against the action of a spring means by introducing the container into the socket, and wherein displacement of the socket operates a switch to start pump operation.

2. Apparatus as claimed in claim 1, wherein the pump is arranged to create a predetermined subatmospheric pressure in the container and the non-return valve is effective to prevent air entering the container.

3. Apparatus as claimed in claim 1, wherein the pump is arranged to create a predetermined superatmospheric pressure in the container and the valve has a retention device to prevent it being blown out of the mouth of the container by the superatmospheric pressure and is effective to prevent air escaping from the container.

4. Apparatus as claimed in claim 3, wherein a filter is fitted to filter the air being charged into the container.

5. Apparatus as claimed in claim 1 further comprising a second socket communicating with the pump, the second socket being adapted to form a seal with a second non-return valve, and wherein the pump is adapted to evacuate air through the first socket and to compress air through the second socket.

6. Apparatus as claimed in claim 5, wherein the first or second socket is displaced against the action of a spring means by introducing the container into the first or second socket, and wherein displacement of the first or second socket operates a switch to start pump operation.

7. Apparatus as claimed in claim 1, wherein the means for stopping the pump from pumping comprises a pressure sensitive switch in the pneumatic circuit connecting the pump to the socket.

8. Apparatus as claimed in claim 7, wherein the switch is effective to stop pump operation on achieving a desired positive or negative pressure.

9. Apparatus as claimed in claim 8, wherein the pneumatic circuit includes a dump valve which is opened when the pressure responsive switch signals that the desired pressure has been achieved, to admit air to the pneumatic circuit so that the non-return valve in the container mouth closes, and the container can be removed from the apparatus.

10. Apparatus as claimed in claim 7, wherein the pressure sensitive switch is effective to close a dump valve in the pneumatic circuit between the pump and the socket.

11. Apparatus as claimed in claim 10, wherein the dump valve is reopened after a short period of time to dump the pressure in the circuit to atmosphere.

12. Apparatus for the preservation of still wine in a part-filled glass wine bottle, the apparatus comprising a non-return valve adapted to be removably fitted in the neck of the bottle, the valve having a slit allowing communication between the valve and the container, a motor driven pump, and a housing unit including a socket communicating with the pump, the socket being adapted to form a seal with the non-return valve allowing communication between the container and the pump via the socket and the valve, the pump being connectable with the valve to create a vacuum inside the bottle, and the apparatus also including means for stopping the pump from pumping through the valve when a predetermined vacuum is achieved, wherein the socket is displaced against the action of a spring means by introducing the container into the socket, and wherein displacement of the socket operates a switch to start pump operation.

13. Apparatus for the preservation of sparkling wine in a part-filled glass wine bottle, the apparatus comprising a non-return valve adapted to be removably fitted in the neck of the bottle, the valve having a hole allowing communication between the valve and the container via the socket and the valve, a motor driven pump, and a housing unit including a socket communicating with the pump, the socket being adapted to form a seal with the non-return valve, the pump being connectable with the valve to create a superatmospheric pressure inside the bottle, and the apparatus also including means for stopping the pump from pumping through the valve when a predetermined pressure is achieved, wherein the socket is displaced against the action of a spring means by introducing the container into the socket, and wherein displacement of the socket operates a switch to start pump operation.

14. Apparatus for the preservation of still and sparkling wines in part-filled glass wine bottles, the apparatus comprising a plurality of non-return valves adapted to be removably fitted in the neck of a bottle, the valve having an opening allowing communication between the valve and the container, a motor driven pump, and a housing unit including a first socket communicating with a suction side of the pump and a second socket communicating with a pressure side of the pump, each socket being adapted to form a seal with at least one of the non-return valves allowing communication between the pump and the container via the socket and the valve, the pump being connectable with the valve to create a change in pressure inside a bottle, and the apparatus also including means for stopping the pump from pumping through the valve when a predetermined pressure is achieved.

* * * * *